US012486731B2

(12) United States Patent
Eriksen

(10) Patent No.: US 12,486,731 B2
(45) Date of Patent: Dec. 2, 2025

(54) DEVICE FOR CONNECTION OR RELEASE OF BOP RAM ACTUATOR

(71) Applicant: ELECTRICAL SUBSEA & DRILLING AS, Straume (NO)

(72) Inventor: Egil Eriksen, Al (NO)

(73) Assignee: ELECTRICAL SUBSEA & DRILLING AS, Straume (NO)

( * ) Notice: Subject to any disclaimer, the term of this patent is extended or adjusted under 35 U.S.C. 154(b) by 0 days.

(21) Appl. No.: 18/693,957

(22) PCT Filed: Sep. 16, 2022

(86) PCT No.: PCT/NO2022/050215
§ 371 (c)(1),
(2) Date: Mar. 21, 2024

(87) PCT Pub. No.: WO2023/048577
PCT Pub. Date: Mar. 30, 2023

(65) Prior Publication Data

US 2024/0384617 A1 Nov. 21, 2024

(30) Foreign Application Priority Data

Sep. 24, 2021 (NO) ..... 20211149

(51) Int. Cl.
*E21B 33/06* (2006.01)

(52) U.S. Cl.
CPC ..... *E21B 33/062* (2013.01)

(58) Field of Classification Search
CPC ..... E21B 33/062; E21B 23/00
See application file for complete search history.

(56) References Cited

U.S. PATENT DOCUMENTS

| | | | | |
|---|---|---|---|---|
| 4,253,638 | A | 3/1981 | Troxell, Jr. | |
| 4,558,842 | A | 12/1985 | Peil et al. | |
| 5,255,890 | A | 10/1993 | Morrill | |
| 5,897,094 | A * | 4/1999 | Brugman | E21B 33/062 251/1.3 |
| 6,554,247 | B2 * | 4/2003 | Berckenhoff | E21B 33/063 166/85.4 |
| 6,845,959 | B2 * | 1/2005 | Berckenhoff | E21B 33/062 166/85.4 |
| 9,260,932 | B2 * | 2/2016 | Weir | E21B 33/062 |
| 11,454,307 | B2 | 9/2022 | Eriksen | |
| 11,459,844 | B2 * | 10/2022 | Moya | E21B 33/061 |
| 2005/0242309 | A1 | 11/2005 | Brugman et al. | |

(Continued)

FOREIGN PATENT DOCUMENTS

WO WO 2019/078727 A1 4/2019

*Primary Examiner* — Umashankar Venkatesan
(74) *Attorney, Agent, or Firm* — Norman B. Thot

(57) ABSTRACT

An apparatus for connecting a ram-actuator to a BOP ram body. The apparatus includes a BOP ram body end portion with locking recesses, a ram-actuator end portion with protruding connection elements which are arranged to fit into the locking recesses, and locking wedges. The locking recesses have first grooves. The protruding connecting elements each have second grooves. The first groves and the second grooves form pairs. Each pair is arranged to form an opening for an insertion of one of the locking wedges when the protruding connection elements are in engagement with the locking recesses in the BOP ram body.

3 Claims, 3 Drawing Sheets

(56) References Cited

U.S. PATENT DOCUMENTS

| | | | | |
|---|---|---|---|---|
| 2008/0142746 | A1* | 6/2008 | Hemphill | E21B 33/063 166/85.4 |
| 2013/0264502 | A1 | 10/2013 | Jahnke | |
| 2013/0313449 | A1 | 11/2013 | Weir et al. | |
| 2016/0377194 | A1 | 12/2016 | Prabhakaran et al. | |
| 2020/0072013 | A1 | 3/2020 | Smith et al. | |

* cited by examiner

DEVICE FOR CONNECTION OR RELEASE OF BOP RAM ACTUATOR

CROSS REFERENCE TO PRIOR APPLICATIONS

This application is a U.S. National Phase application under 35 U.S.C. § 371 of International Application No. PCT/NO2022/050215, filed on Sep. 16, 2022 and which claims benefit to Norwegian Patent Application No. 20211149, filed on Sep. 24, 2021. The International Application was published in English on Mar. 30, 2023 as WO 2023/048577 A1 under PCT Article 21(2).

FIELD

The present invention relates to equipment for drilling and well-operations, and in particular to the attachment of ram-actuator assemblies to BOP ram bodies.

BACKGROUND

Drilling BOPs are provided with hydraulically or electrically activated pipe rams to close tightly around the drill string in the vertical center bore of the BOP, and shear rams, which may be used to seal off the well if well control cannot be maintained through other non-destructive actions. The rams are fitted into cavities in the forged and machined steel blocks/bodies which are assembled into a complete BOP stack. Two radially opposing ram-actuator bonnet fixtures are provided for sealing engagement with the corresponding end faces of the body, where the ram elements are inserted into their respective cavities.

The shearing devices or sealing pipe rams must be periodically examined, refurbished and/or replaced. The ram-actuator bonnet fixtures are known in the industry as "ram doors". A door has traditionally been secured to the body by a plurality of large bolts, circumferentially spaced about the ram axis. To allow access to the serviceable components, the bolts are removed, and the door is structurally disconnected from the ram body, thereby exposing seals and ram elements for repair or replacement.

BOP doors may be mounted on the BOP body by a hinge, as described in U.S. Pat. Nos. 4,253,638 and 5,255,890, so that the BOP body supports the opened door during the service operation.

The disconnected doors may alternatively each be moved along support members coupled to the ram body, as described in US 2008/0142746 A1.

The laborious and time-consuming operation of disengaging bolted bonnets from ram bodies, and subsequent reassembly, may contribute to so-called "flat-time" between wells during service of a BOP stack. Operational inefficiency and other disadvantages of bolted doors can be overcome by boltless door solutions. Background technology is described in U.S. Pat. No. 5,897,094, US 2013/0264502 A1, and US2016/0377194 A1. US 2020/0072013 describes a ram block inner seal assembly for use with a BOP comprising a core member and a peripheral member comprised of a material suitable for providing the ram block inner seal assembly.

SUMMARY

An aspect of the present invention is to remedy or reduce at least one of the drawbacks of the prior art or to at least provide a useful alternative to the prior art.

In an embodiment, the present invention provides an apparatus for connecting a ram-actuator to a BOP ram body. The apparatus includes a BOP ram body end portion with locking recesses, a ram-actuator end portion with protruding connection elements which are arranged to fit into the locking recesses, and locking wedges. The locking recesses comprise first grooves. The protruding connecting elements each comprise second grooves. The first groves and the second grooves form pairs. Each pair is arranged to form an opening for an insertion of one of the locking wedges when the protruding connection elements are in engagement with the locking recesses in the BOP ram body.

BRIEF DESCRIPTION OF THE DRAWINGS

The present invention is described in greater detail below on the basis of embodiments and of the drawings in which.

DETAILED DESCRIPTION

A first aspect of the present invention provides an apparatus for connecting a BOP ram body to a ram-actuator, the apparatus comprising a BOP ram body end portion with locking recesses, and a ram-actuator end portion with protruding connection elements arranged to fit into the locking recesses, wherein the locking recesses are provided with first grooves and the protruding connection elements are provided with second grooves, and wherein the first and second grooves form pairs, each pair being arranged to form an opening for insertion of a locking wedge when the protruding connection elements are in engagement with the locking recesses in the ram body.

The arrangement may further comprise at least one locking wedge which is provided with an inclined surface adapted to abut against a slanted surface in the grooves on the protruding connection elements of the ram-actuator.

The openings for insertion of at least one locking wedge are advantageous in that the ram-actuators may be connected to the BOP ram body by insertion of locking wedges in the openings. Connecting and disconnecting the ram actuator to and from the BOP ram body can therefore be carried out by insertion or removal of the locking wedges by, for example, actuation of the locking wedges via an actuator. The actuator may be a linear actuator which is operable to insert and remove the locking wedge from the openings, thereby providing an arrangement for boltless attachment of ram actuators to a BOP ram body.

The locking recesses may be positioned in the corners or close to the corners of the ram body portion.

The locking wedge may comprise at least one internal pressure channel with a lubricant injection port at an outer end for distribution of high-pressure lubricants.

The locking wedge may comprise at least one lubricant outlet at a side surface of the at least one locking wedge.

A benefit of having internal pressure channels with lubricant injection ports and outlets at a side surface of the locking wedges is that before removal of the wedges, a lubricant can be injected in the pressure channels, thereby facilitating an easy removal of the wedges.

A second aspect of the present invention provides using electro-mechanical ram-actuators (described in WO 2019/078727 A1) locked onto and sealed against end faces of a BOP ram body with protruding connection elements of the ram-actuators inserted into cavities in the BOP ram body. The ram-actuators are fixed to the bodies with locking wedges that are pushed from the sides of the ram body into openings that are formed when the ram-actuators are connected to the body so that grooves in the protruding connection elements of the ram-actuators are aligned with grooves in the locking recesses at the corners of the ram body.

An example of an embodiment is described below which is illustrated in the accompanying drawings.

Figure 1:
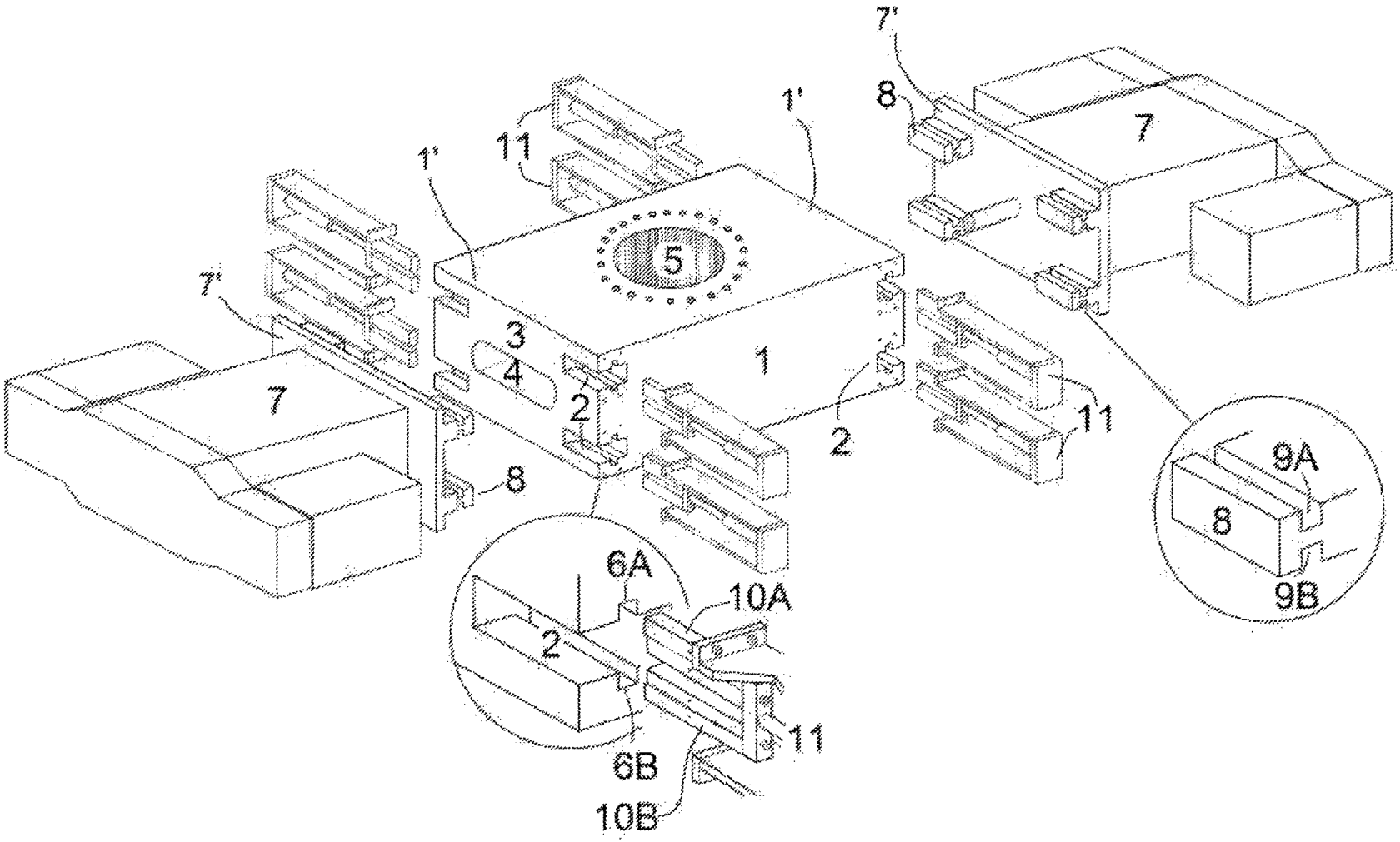
FIG. 1 shows a perspective "exploded view" of a ram body with an electro-mechanical ram-actuator at each end and four locking wedge actuators on each side of the ram body.

The apparatus shown in FIG. 1 comprises a BOP ram body 1 and two ram-actuators 7. The BOP ram body 1 comprises locking recesses 2 in BOP ram body end portions 1' of the BOP ram body 1. FIG. 1 shows four locking recesses 2 which are arranged in each of the end portions 1'. Each locking recess 2 is positioned close to corners of the end portions 1' of the BOP ram body 1. A cavity 4 is shown at an end face 3 of the BOP ram body end portion 1' where the ram elements (not shown) are inserted. A vertical center bore 5 can be seen on top of the body, which forms part of the wellbore of an assembled BOP stack. First top groove 6A and first bottom groove 6B are included in the locking recesses 2.

FIG. 1 further shows the ram-actuators 7 disconnected from the BOP ram body 1. The ram-actuators 7 can be moved back on a set of support members (which are not shown) coupled to the ram body 1. As shown in FIG. 1, ram-actuator portions 7' are provided with protruding connection elements 8 which fit into the locking recesses 2 at the BOP ram body end portions 1' of the BOP ram body 1. First top groove 6A and first bottom groove 6B in the locking recesses 2 correspond with second top groove 9A and second bottom groove 9B in the ram connecting element 8, respectively, when the ram-actuators 7 are fully connected to the BOP ram body 1. Each of the first top groove 6A and the first bottom groove 6B forms a pair of opposing grooves with one second top groove 9A and second bottom groove 9B, so that the pair forms an opening.

Figure 2:
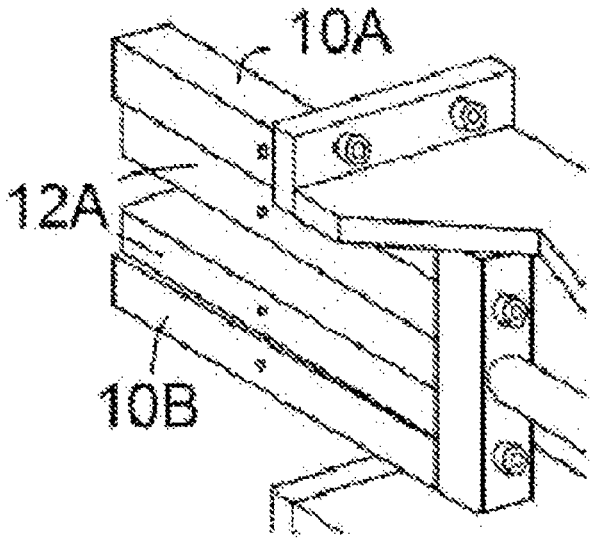
FIG. 2 shows a single locking wedge actuator with two locking wedges.

The ram-actuators 7 can be fixed to the BOP ram bodies 1 with locking wedges 10A, 10B inserted into the openings between pairs of opposing grooves 6A, 6B and 9A, 9B via locking wedge actuators 11 mounted on the sides of the BOP ram body 1. A locking wedge actuator 11, with a top and bottom locking wedge 10A, 10B, is shown in FIG. 2, where inclined surfaces 12A are also shown.

Figure 3:
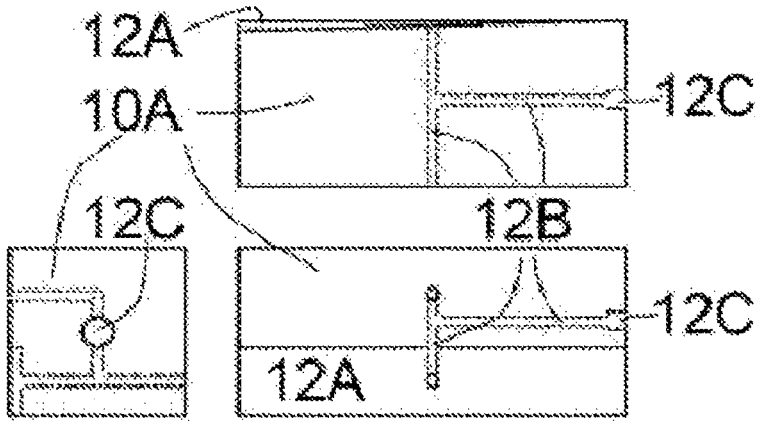
FIG. 3 shows details of a locking wedge.
Figure 4:
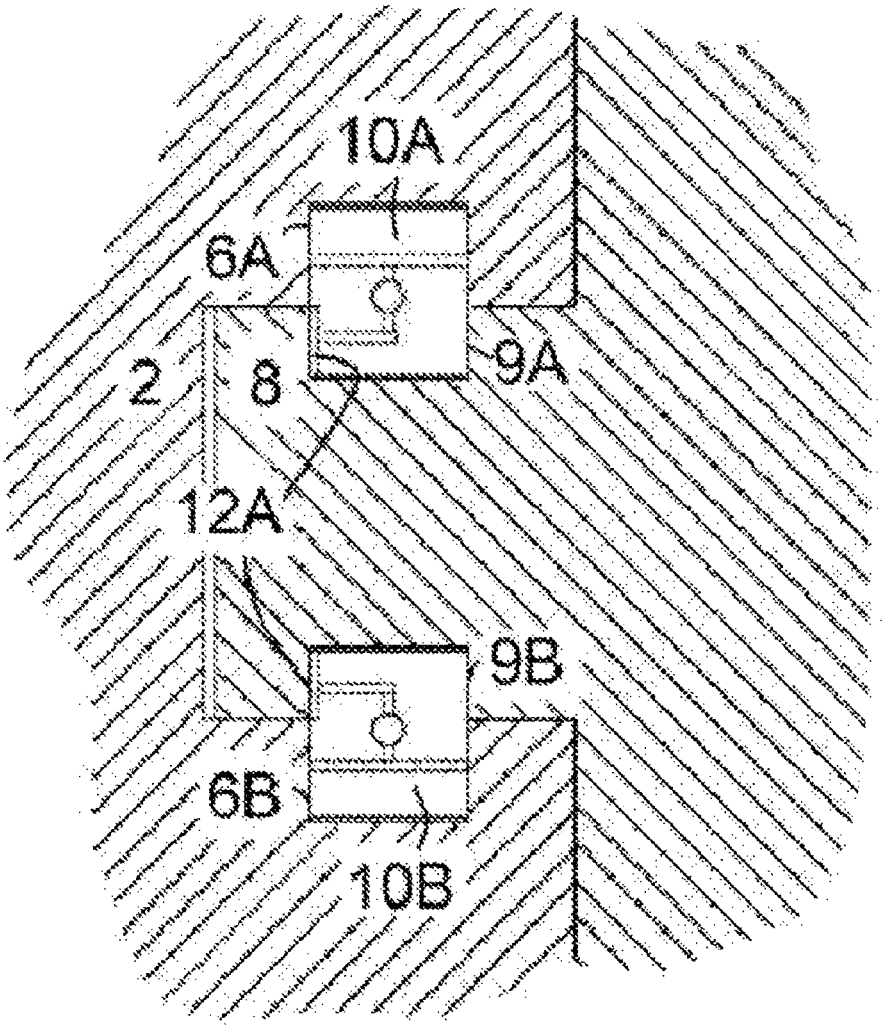
FIG. 4 shows a cross section of a ram-actuator locking interface where locking wedges are pushed in to keep the ram-actuator fixed to the ram block.

Reference is now made to FIGS. 3 and 4.

The locking wedges 10A, 10B have an inclined surface 12A which will slide along a corresponding slanted surface inside the grooves 9A, 9B on the protruding connection elements 8 on the ram-actuators 7, as the wedges are pushed into the openings between the opposing grooves 6A, 6B and 9A, 9B. When they have been fully pushed into the locking position, the locking wedges 10A, 10B will force the connection elements 8 into a tight contact with the locking recesses 2 in the BOP ram body 1, thereby providing a pressure tight seal (which is not shown) between the ram-actuator 7 and the end face 3 of the BOP ram body 1.

The fully inserted locking wedges 10A, 10B will be stuck in the spaces between the opposing grooves 6A, 6B and 9A, 9B. To release the locking wedges 10A, 10B, to enable a full wedge retraction, the wedges are provided with internal lubrication/pressure channels 12B, which can be pressurized with lubricant through a lubricant injection port 12C at the outer end of the locking wedges 10A, 10B. The high-pressure lubricant will exit from openings at the side surfaces of the locking wedges 10A, 10B and thus aid the release and retraction of the locking wedges 10A, 10B with the locking wedge actuators 11.

The present invention is not limited to embodiments described herein; reference should be had to the appended claims.

LIST OF REFERENCE NUMERALS

1 BOP ram body
1' BOP ram body end portion
2 Locking recess
3 End face (of the BOP ram body)
4 Cavity
5 Vertical center bore
6A First (top) groove
6B First (bottom) groove
7 Ram-actuator
7' Ram-actuator end portion
8 Protruding connection element
9A Second (top) groove
9B Second (bottom) groove
10A Top locking wedge
10B Bottom locking wedge
11 Locking wedge actuator
12A Inclined surface
12B Internal lubrication/pressure channel
12C Lubricant injection port

What is claimed is:

1. An apparatus for connecting a ram-actuator to a BOP ram body, the apparatus comprising:

a BOP ram body end portion with locking recesses, the locking recesses comprising first grooves;

a ram-actuator end portion with protruding connection elements which are arranged to fit into the locking recesses, the protruding connecting elements each comprising second grooves; and locking wedges, wherein, the first groves and the second grooves form pairs, each pair being arranged to form an opening for an insertion of one of the locking wedges when the protruding connection elements are in engagement with the locking recesses in the BOP ram body, the locking wedges each comprise an inclined surface, the second grooves each comprise a slanted surface, and a respective inclined surface is configured to abut against a respective slanted surface on a respective protruding connection element of the ram actuator.

2. The apparatus as recited in claim 1, wherein the locking wedges each further comprise at least one internal pressure channel having a lubricant injection port at an outer end thereof for distribution of a high-pressure lubricant.

3. The apparatus as recited in claim 1, wherein the locking wedges each further comprise at least one lubricant outlet at a side surface thereof.

* * * * *